US006244548B1

(12) United States Patent
Gillette

(10) Patent No.: US 6,244,548 B1
(45) Date of Patent: Jun. 12, 2001

(54) LADDER BRACKET ADAPTER

(75) Inventor: Willard D. Gillette, Fremont, CA (US)

(73) Assignee: Searcy Enterprises, Fremont, CA (US)

( * ) Notice: Subject to any disclaimer, the term of this patent is extended or adjusted under 35 U.S.C. 154(b) by 0 days.

(21) Appl. No.: 09/415,711

(22) Filed: Oct. 12, 1999

(51) Int. Cl.[7] ..... E06C 7/14
(52) U.S. Cl. ..... 248/210
(58) Field of Search ..... 248/210, 211, 248/238; 182/129

(56) References Cited

U.S. PATENT DOCUMENTS

| | | | | |
|---|---|---|---|---|
| 4,139,173 | * | 2/1979 | Kahn | 248/211 X |
| 4,515,242 | * | 5/1985 | LaChance | 182/129 X |
| 5,797,571 | * | 8/1998 | Brophy | 248/210 |
| 5,816,363 | | 10/1998 | Searcy . | |
| 6,105,911 | * | 8/2000 | Olexson | 248/211 |

* cited by examiner

*Primary Examiner*—Ramon O. Ramirez

(57) ABSTRACT

An adapter for a ladder bracket support for a paint container includes a channel member having a central web portion flanked by a pair of side web portions. The central web portion is raised slightly with respect to the side web portions, and a curved tongue extends from a proximal end of the central web portion. A rectangular tube is secured to the bottom of the central web portion, extending generally perpendicularly downwardly. A locking pin extends laterally through aligned holes in the side walls of the channel portion. The curved tongue extends about a tubular member of a scaffolding, with the channel member extending outwardly and horizontally. The rectangular tube extends downwardly to engage a lower tubular member and maintain the channel member extending horizontally. The hook-end members of the ladder bracket extend adjacent the curved tongue and about the tubular scaffolding member on which the curved tongue rests, whereby the channel provides horizontal support for the ladder bracket while the hook-ends of the ladder bracket retain the adapter on the tubular scaffolding member. The locking pin retains the lateral portions of the hook-end member of the ladder bracket in the channel member. Thus the ladder bracket cannot be removed from the adapter, and the engagement of the hook-end members of the ladder bracket prevents removal of the assembly from the scaffolding.

10 Claims, 4 Drawing Sheets

LADDER BRACKET ADAPTER

BACKGROUND OF THE INVENTION

The present invention relates to paint container holders for use in conjunction with ladders, and, more particularly, to an adapter that permits the paint container holder to be used in conjunction with a scaffolding or other aerial support.

An exemplary paint container holder is disclosed in U.S. Pat. No. 5,816,363. This device includes an arcuate support for a paint bucket and work tray, and a bracket portion that is adapted to engage a horizontal step of a typical step ladder or the like. Although this device provides great utility in aiding painters, plasterers, and other skilled trades workers, it is somewhat limited to its intended use with ladders that have steps or similar lateral members to be engaged by the bracket portion.

There is an unmet need in the prior art for a paint container holder that is usable with other worker support structures, such as tubular scaffolding or the basket of mechanical lift systems commonly used for painting and similar craft work.

SUMMARY OF THE INVENTION

The present invention generally comprises an adapter for a ladder bracket support for a paint container and work tray. The adapter enables a ladder bracket support to be employed in conjunction with tubular scaffolding and other support structures.

The ladder bracket support adapter includes a longitudinally extending channel portion having a central web portion flanked by a pair of side web portions, all extending longitudinally. The central web portion is raised slightly with respect to the side web portions, and a curved tongue extends from a proximal end of the central web portion. A rectangular tube is secured adjacent to the tongue to the bottom surface of the central web portion, extending generally perpendicularly downwardly. A reinforcing member extends obliquely from the bottom surface of the central web portion to the rectangular tube. A locking pin is also provided, extending laterally through aligned holes in the side walls of the channel portion.

The components enumerated above are arranged in particular to support the bracket portion of the ladder bracket disclosed in U.S. Pat. No. 5,816,363. The curved tongue is disposed to extend about a tubular member or rail of a scaffolding or other worker support structure, with the channel portion extending outwardly and generally horizontally therefrom. The rectangular tube extends downwardly from the channel portion to engage a lower tubular member or other structural component of the scaffolding, whereby the adapter is maintained with the channel portion extending generally horizontally.

The ladder bracket support includes a pair of hook-end members that are generally intended to engage a step of a ladder. The lateral portions of the hook-end members are received in supporting relationship by the side web portions of the channel, and the hook ends extend adjacent to the curved tongue and about the laterally extending tubular scaffolding member on which the curved tongue rests. This engagement provides a synergistic result, as the channel provides horizontal support for the ladder bracket and its paint bucket or work tray, while the hook-ends of the ladder bracket retain the adapter on the tubular scaffolding member. The locking pin may be secured to the side panels of the channel member to retain the lateral portions of the hook-end member of the ladder bracket in the channel member. Thus the ladder bracket cannot be removed from the adapter, and the engagement of the hook-end members of the ladder bracket prevents removal of the assembly from the scaffolding.

With the ladder bracket thus supported on a lateral tubular member of the scaffolding, the arcuate distal end of the ladder bracket may be used to support a bucket for paint, spackling, or other filling/surfacing compounds, or to support a work tray for tools, hardware, and paint.

DESCRIPTION OF THE PREFERRED EMBODIMENT

Figure 2:
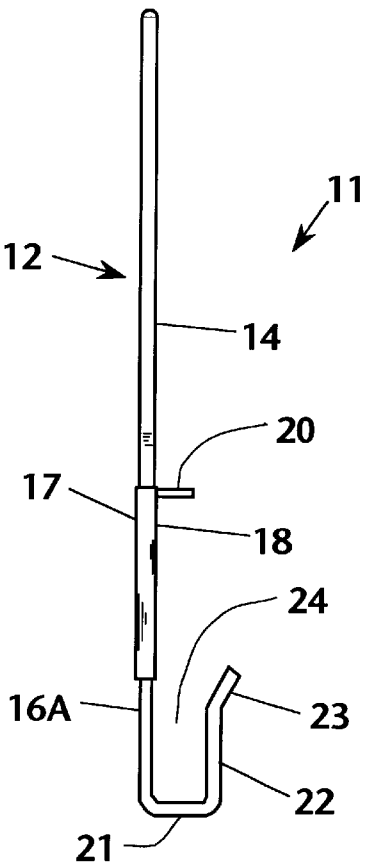
FIG. 2 PRIOR ART
FIG. 2 is a side view of the ladder bracket support known in the prior art and depicted in FIG. 1.
Figure 1:
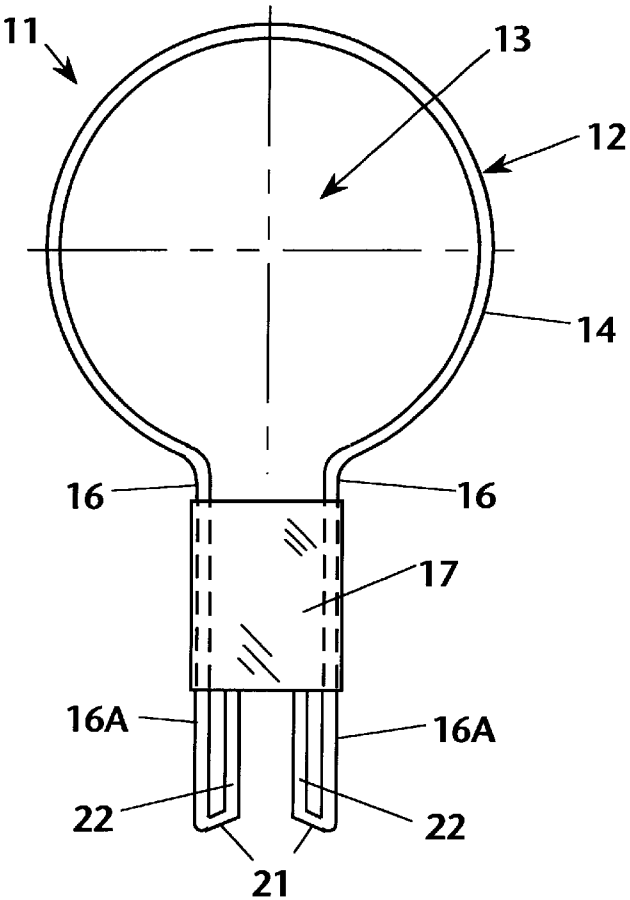
FIG. 1 PRIOR ART
FIG. 1 is a plan view of a ladder bracket support known in the prior art.
Figure 5:
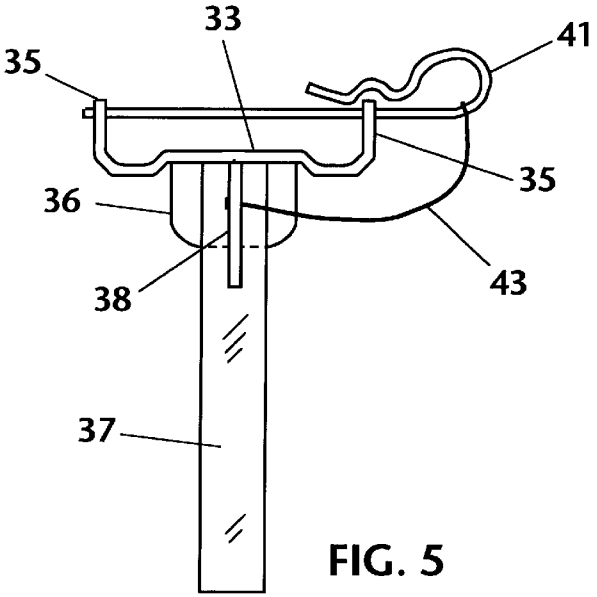
FIG. 5 is an end view of the ladder bracket adapter shown in FIGS. 3 and 4.

With regard to FIGS. 1 and 2, a prior art ladder bracket 11 includes an arcuate portion 12 comprised of stiff wire or rod material 14 formed in a smooth curved shape defines a central opening 13. The opening 13 is dimensioned to receive a paint container or bucket having a (typical) standard size such as 2 gallons, 5 gallons, or the like. The wire or rod 14 describes substantial portion of a closed curved loop, whereby a cylindrical container may be encircled and supported within.

Figure 3:
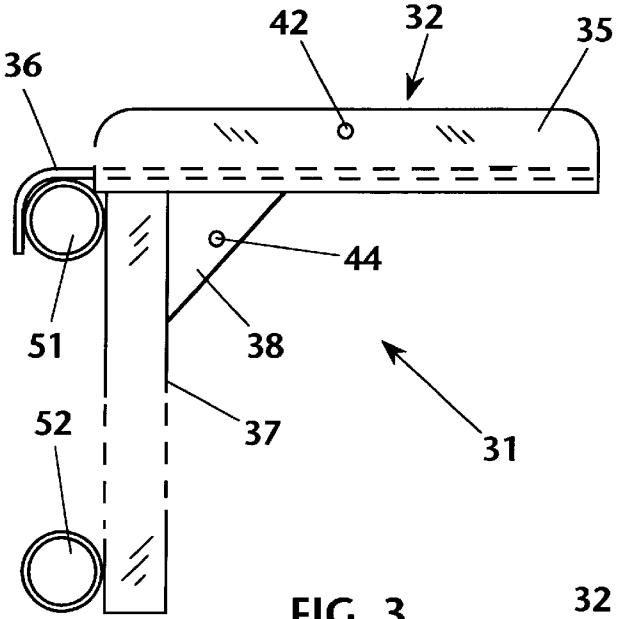
FIG. 3 is a side elevation of the ladder bracket adapter of the present invention.
Figure 4:
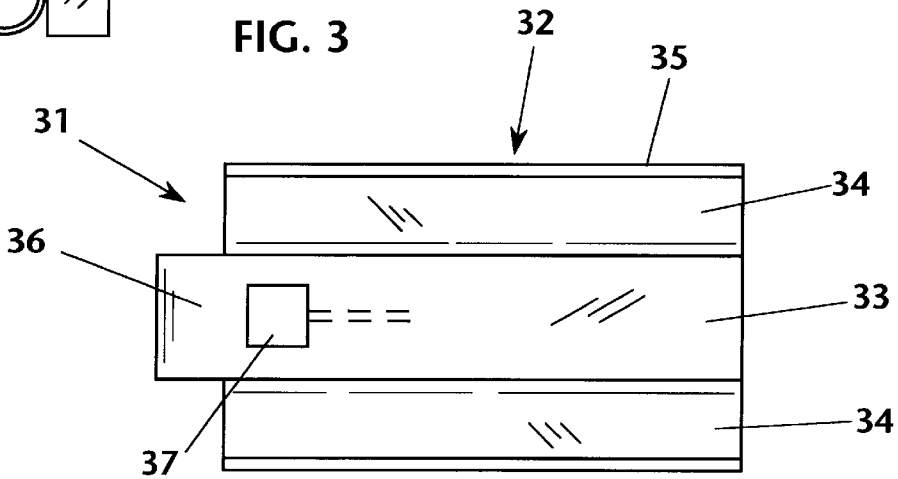
FIG. 4 is a plan view of the ladder bracket adapter depicted in FIG. 3.

The wire or rod member 14 extends integrally from the arcuate portion 12 as a pair of linear portions 16 disposed in parallel, spaced apart fashion. A tang member 17 comprised of a plate-like component includes opposed sides having curved edge portions 18 that substantially circumscribe and secure the linear portions 16, forming a rigid assembly therewith. A flange 20 is formed at one end of the tang 17 and extends between the linear segments 16, as shown in FIGS. 2 and 3. The paired linear segments extend proximally past the tang 17 as segments 16A, and undergo right angle bends to form short transition segments 21 that converge slightly each toward the other. Further right angle bends define retrograde segment 22 that extend generally parallel to their respective progenitor portions 16A. Each segment 22 terminates with a short segment 23 bent obliquely away from the tang 17. The segments 22 and 16A define therebetween an opening 24 intended to receive a step of a ladder or the like.

With reference to FIGS. 3–6, the present invention comprises an adapter 31 for the prior art device depicted in FIGS. 1 and 2 that enables the ladder bracket to be employed with a far wider range of worker support structures. The adapter 31 includes a channel member 32 extending longitudinally, the channel member including a central web portion 33 flanked by a pair of side web portions 34. The central web portion 33 is raised slightly with respect to the portions 34, and portions 33 and 34 extend longitudinally between opposed side panels 35. A tongue 36 extends from a proximal end of the central web portion 33, and is provided with a smooth curved conformation that extends through an angular excursion of approximately 90°. The channel member 32 and tongue 36 may be formed integrally from a single piece of sheet metal stamped and formed as shown and described.

The adapter 31 further includes a rectangular tube 37 extending transverse to the central web portion 33 and joined thereto by welding or the like. The tube 37 is disposed adjacent to the proximal end of the central web portion and to the tongue 36. A generally triangular reinforcing web 38 extends in a plane that includes the axis of the tube 37, the web 38 having adjacent sides secured to the tube 37 and to the bottom surface of the central web portion 33 to rigidify the junction of the tube 37 and the channel member 32.

The adapter 31 further includes a locking pin 41 adapted to be received through aligned holes 42 in the opposed side panels 35 of the channel member 32. A tether 43 is secured to the pin 41, the tether being tied to a hole 44 formed in the web 38.

Figure 7:
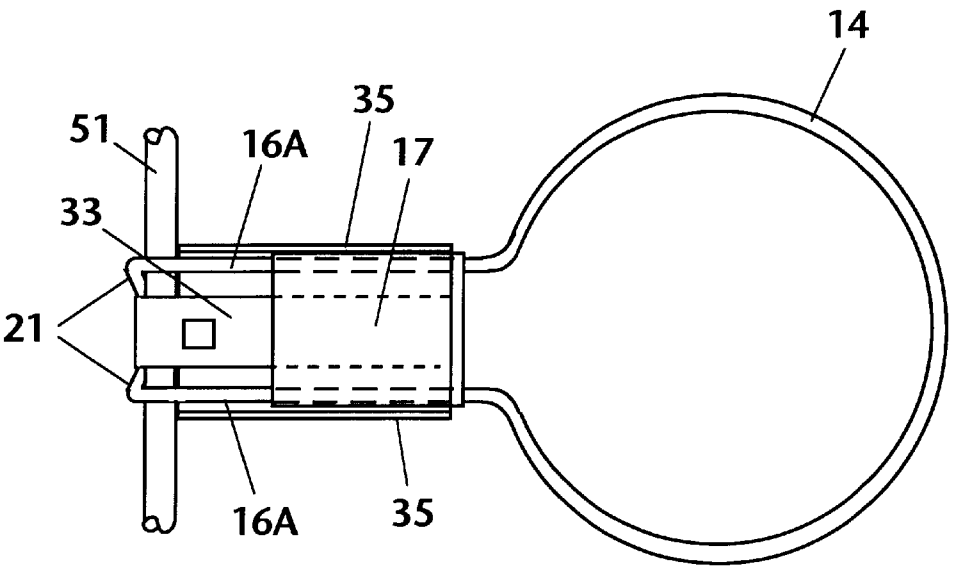
FIG. 7 is a plan view showing the ladder bracket adapter of the invention engaged with a typical prior art ladder bracket as depicted in FIGS. 1 and 2.
Figure 6:
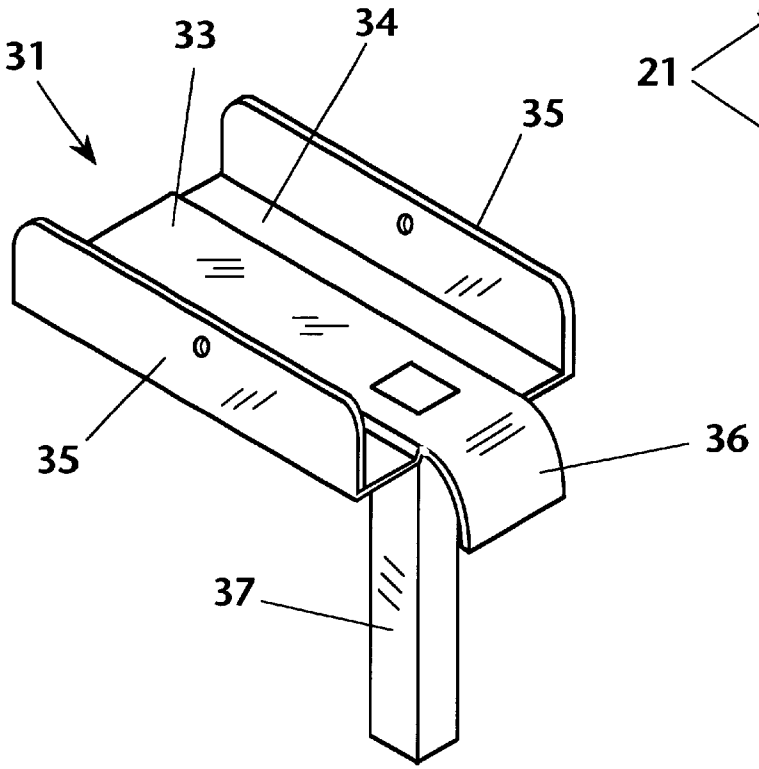
FIG. 6 is a perspective view of the ladder bracket adapter shown in FIGS. 3–5.
Figure 8:
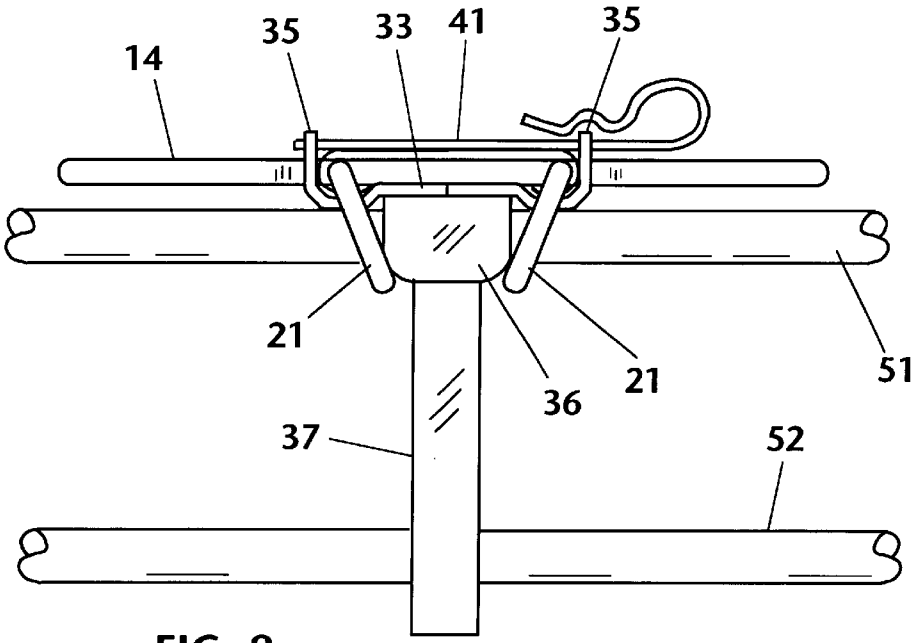
FIG. 8 is an end view of the ladder bracket adapter of the invention engaged with a typical prior art ladder bracket as depicted in FIG. 7.
Figure 9:
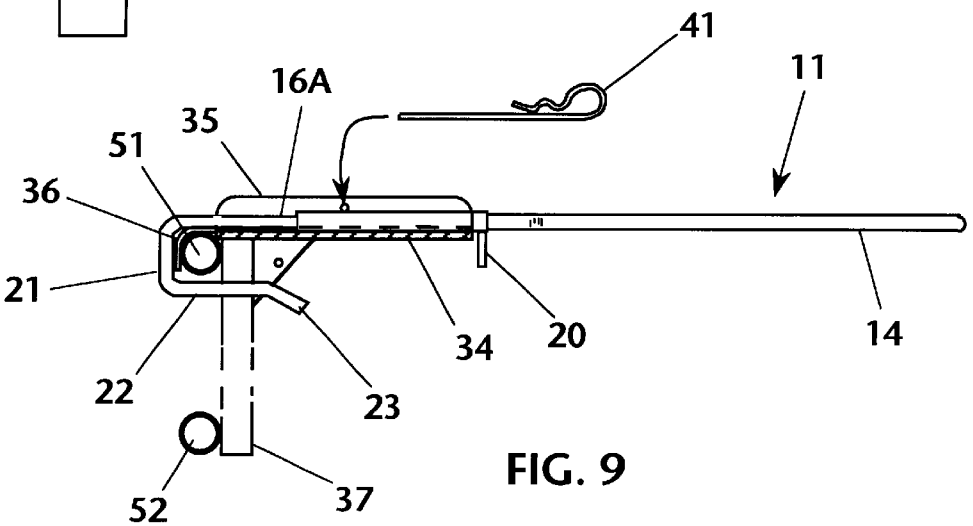
FIG. 9 is a side view of the ladder bracket adapter of the invention engaged with a typical prior art ladder bracket as depicted in FIGS. 7 and 8.

With reference to FIGS. 7–9, the adapter 31 described above and depicted in FIGS. 3–6 may be employed with the prior art ladder bracket device shown in FIGS. 1 and 2. The adapter 31 is disposed with the tongue 36 extending over a tubular support or upper rail 51 of a scaffolding or other worker support structure. The tongue 36 thus provides a vertical bearing engagement with a fixed structural member that supports the weight of the adapter 31 and the ladder bracket 11. The rectangular tube 37 extends downwardly to impinge on a lower tubular or structural member 52 of the worker support structure, whereby the channel member 32 is maintained in a generally horizontal disposition. The ladder bracket 11 is supported by the adapter 31 with the linear portions 16 and 16A of the device 11 resting on the side web portions 34 of the adapter 31, and the flange 20 extends directly adjacent to the distal end of the channel member 32. Thus the adapter supports the weight of the device 11 and the paint bucket supported thereby.

The hook ends 21–23 of the device 11 are disposed to flank the tongue 36 (FIG. 8), and are passed about the structural member 36 of the worker support structure (FIG. 9). This engagement provides a synergistic effect, in that the hook ends secure the device 11 as well as the adapter 31 to the worker support structure, preventing accidental dislodgment of the assembly from the worker support structure. The locking pin 41 is placed through the aligned holes 42 in the side panels 35 of the channel member, thus securing the linear portions 16 and 16A of the device 11 in the channel member 32. Thus the device 11 cannot be removed from the adapter 31, and the engagement of the hook-end members of the ladder bracket 11 prevents removal of the assembly from the worker support structure.

Thus the adapter 31 permits the device 11 to be used effectively with a wide range of worker support structures commonly used in the construction trades. With the ladder bracket thus supported on a lateral tubular member of the scaffolding, the arcuate distal end of the ladder bracket may be used to support a bucket for paint, spackling, or other filling surfacing compounds, or to support a work tray for tools, hardware, and paint.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. An adapter for mounting a ladder bracket on a worker support structure, including:

a channel member having a proximal end;

means extending from said proximal end of said channel member for overlaying and engaging an upper surface of a first laterally extending portion of said worker support structure; and, a tubular member secured to said channel member adjacent to said proximal end for engaging a second laterally extending portion of said worker support structure vertically spaced from said first laterally extending portion.

2. The adapter of claim 1, wherein said tubular member extends generally perpendicularly from a bottom surface of said channel member.

3. The adapter of claim 1, wherein said channel member includes opposed side panels, and further including a locking pin extending through said side panels to retain said bracket in said channel member.

4. The adapter of claim 1, wherein said means for engaging includes a tongue extending integrally from said channel member.

5. The adapter of claim 4, wherein said tongue is curved through an angular excursion of approximately 90°.

6. An assembly for supporting a paint bucket from a worker support structure having a lateral tubular member, including:

a ladder bracket comprised of an arcuate portion adapted to receive the paint bucket in supporting relationship, a pair of linear rod portions extending generally horizontally from said arcuate portion, an a pair of hook ends, each hook end extending from a respective proximal end of one of said pair of linear rod portions;

an adapter for said ladder bracket, including a channel member disposed to engage and support said linear rod portions, a tongue portion extending from said channel member and disposed to engage the lateral tubular member and support said adapter and said ladder bracket, and a vertical tubular member extending downwardly from said channel member to engage the worker support structure and maintain said channel member in generally horizontal disposition.

7. The assembly of claim 6, further including a locking pin extending between opposed sides of said channel member to secure said linear rod portions in said channel member and prevent disassembly or removal of said ladder bracket from said adapter.

8. The assembly of claim 6, further including a reinforcing web extending between said vertical tubular member and said channel member.

9. The assembly of claim 6, wherein said hook ends extend about the lateral tubular member to secure said ladder bracket and said adapter to said worker support structure.

10. The assembly of claim 9, wherein said tongue portion is disposed between said pair of hook ends.

* * * * *